US005387078A

United States Patent [19]

Todaro

[11] Patent Number: 5,387,078

[45] Date of Patent: Feb. 7, 1995

[54] DISK LIFT SEPARATOR

[75] Inventor: Frank A. Todaro, Old Saybrook, Conn.

[73] Assignee: General Binding Corporation, Northbrook, Ill.

[21] Appl. No.: 150,219

[22] Filed: Nov. 10, 1993

[51] Int. Cl.[6] ..... B65H 3/32; B65G 59/00

[52] U.S. Cl. ..... 414/798.9; 414/796; 414/797.3; 414/786; 271/113; 271/117

[58] Field of Search ..... 414/786, 797.7, 797.3, 414/796, 796.1, 798.9; 271/113, 117, 121, 149, 150; 221/297, 221

[56] References Cited

U.S. PATENT DOCUMENTS

| | | |
|---|---|---|
| 3,122,230 | 2/1964 | Boque . |
| 3,125,229 | 3/1964 | Mulquin et al. . |
| 3,391,806 | 7/1968 | Geis et al. . |
| 3,452,628 | 7/1969 | Pfaffle . |
| 3,627,152 | 12/1971 | Pfaffle . |
| 3,650,525 | 3/1972 | Hageman et al. . |
| 3,672,516 | 6/1972 | Nordstrand . |
| 3,690,475 | 9/1972 | Pfaffle . |
| 3,741,410 | 6/1973 | Henschke et al. ..... 414/797.7 |
| 3,826,348 | 7/1974 | Preisig et al. . |
| 3,908,984 | 9/1975 | Sohngen . |
| 4,286,908 | 9/1981 | Pfaffle . |
| 4,429,864 | 2/1984 | Scarpa et al. . |
| 4,511,134 | 4/1985 | Hughes . |
| 4,616,818 | 10/1986 | Vischer . |
| 5,044,877 | 9/1991 | Constant et al. . |

FOREIGN PATENT DOCUMENTS

| | | | |
|---|---|---|---|
| 799182 | 6/1936 | France . | |
| 100570 | 9/1978 | Japan | 414/797.7 |
| 2022561 | 12/1979 | United Kingdom | 414/797.7 |
| 2242895 | 10/1991 | United Kingdom | 414/797.7 |

*Primary Examiner*—Karen B. Merritt
*Attorney, Agent, or Firm*—Hill, Steadman & Simpson

[57] ABSTRACT

A method and apparatus for separating groups of sheets from a stack for a punching or binding operation. The invention uses a dual disk arrangement having a front disk and a rear disk. The arrangement is for separating a substack from a stack of pages, the substack temporarily resting on the rear disk, and divided by the front disk. The arrangement includes a plurality of rollers downstream of the substack to transport the substack to a downstream processing station.

13 Claims, 3 Drawing Sheets

DISK LIFT SEPARATOR

BACKGROUND OF THE INVENTION

The present invention relates to an apparatus and method for separating groups of sheets of paper from a cue or stack of sheets to be processed downstream in a further operation such as punching and/or binding. The apparatus and method are useful for segregating successive "lifts" or groups of sheets for producing booklets or books, etc.

U.S. Pat. No. 3,391,806 discloses a separator-transfer system which separates and transfers articles such as magazines, newspapers and similar printed publications from a stack to a remote location. This device uses a rotating support (22) and jaws (20, 23) to separate the lift of pages for further processing.

U.S. Pat. No. 3,452,628 discloses a horizontal stack of sheets wherein a substack of sheets is separated by two disks (31, 32).

A simple, effective and rapidly acting disk separator means of the present invention, which allows separation of groupings of pages in succession for further processing such as punching or binding is not heretofore known.

SUMMARY OF THE INVENTION

It is an object of the present invention to provide a simple effective, rapidly acting disk lift separator for separating stack of pages successively into groupings of pages for punching and/or binding. The objects of the invention are achieved in that an apparatus is provided which supports an inclined horizontal cue of substantially vertically oriented sheets on conveyor means which feeds the sheets into a separation station which provides a rotating disk separator which separates a desired thickness or "lift" of sheets and transfers the lift of sheets to a further station.

The separation station provides a two-layer disk assembly mounted on a single axle. A front disk which faces the stack is generally circular, but mounted eccentrically onto the axle. The rear disk is generally circular and mounted coaxially onto the axle, but having a peripheral portion removed along a straight line chord. The rear disk can have a greater outer diameter than the front disk.

Mounted around a partial perimeter of the front disk is a generally cylindrical wall or cam having an inclined edge and extending perpendicular to the plane of the front disk toward and past the rear disk. The inclined edge provides a wedge effect which, once the front disk slices into the stack, moves a corner of the lift or "substack" away from the remainder of the stack.

The rear disk moves into position extending outward of the front disk to support a next successive substack of pages beneath the front disk. The front disk can then rotate around to slice and separate this next successive substack in a repeating operation.

A wedge moves downwardly into the gap created by the inclined edge of the cylindrical wall to separate the substack from the stack. A roller wheel arrangement is arranged downstream of the separated substack of pages which grasps the substack and transfers the substack to a further processing station.

DETAILED DESCRIPTION OF THE PREFERRED EMBODIMENTS

Figure 1:
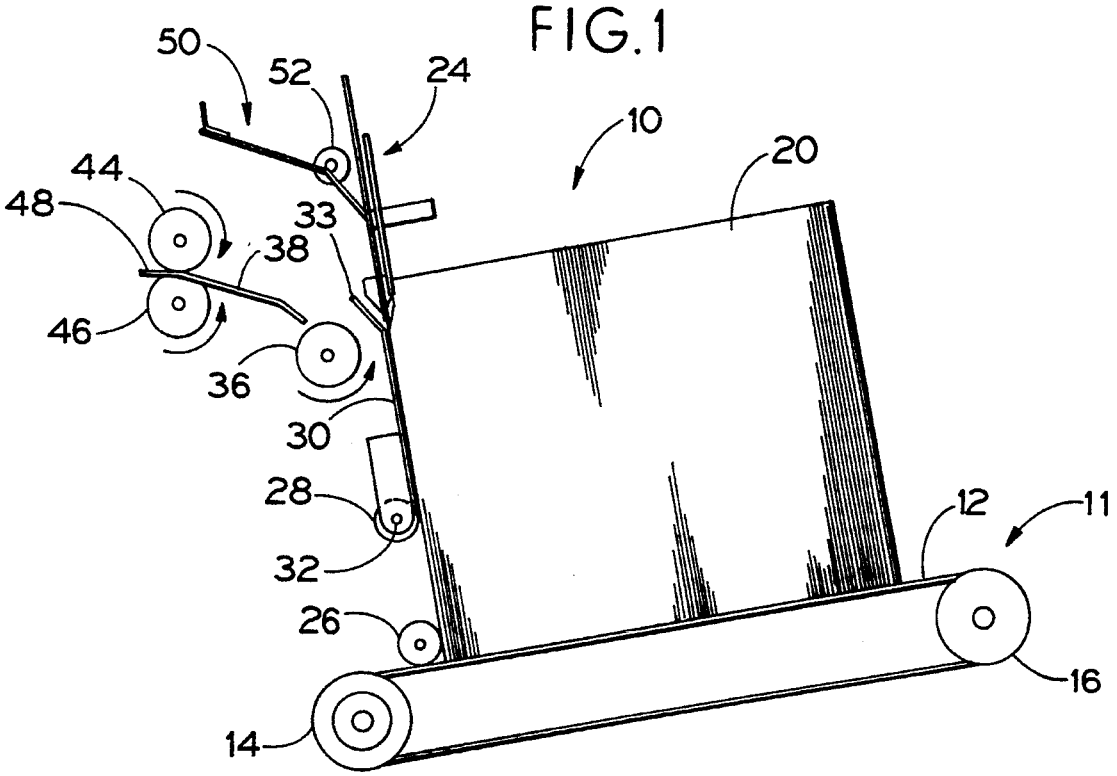
FIG. 1 is an elevational view of the apparatus of the present invention.
Figure 2:
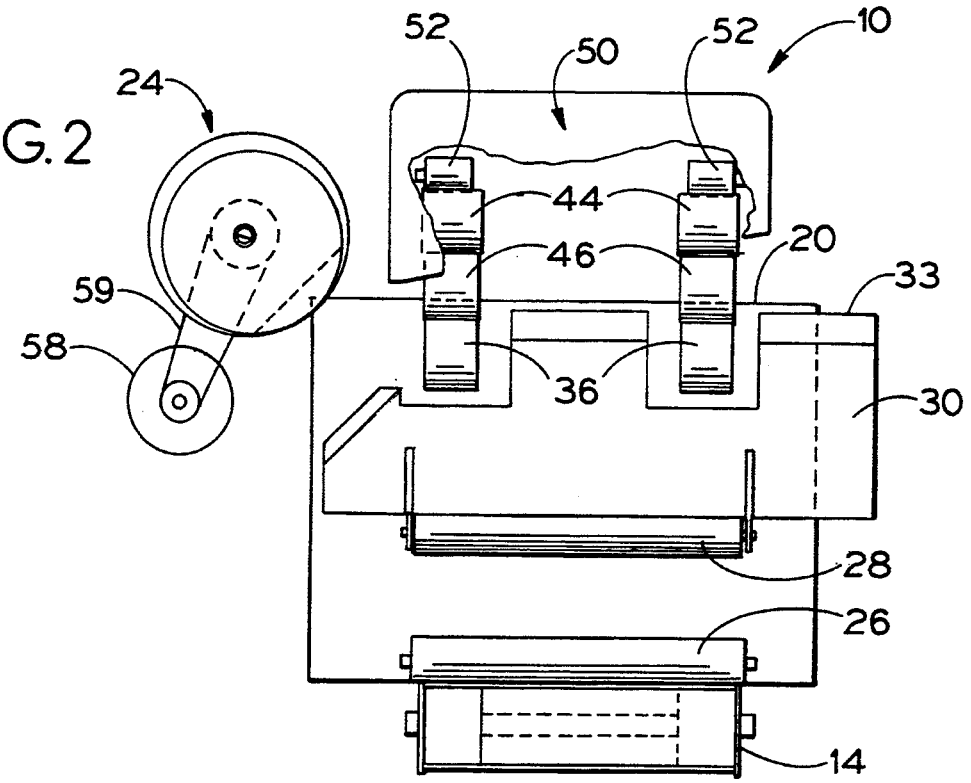
FIG. 2 is a left side view of the apparatus of FIG. 1.

FIG. 1 and FIG. 2 illustrate a separation and transfer station 10 of the present invention. The station provides a conveyor hopper 11 having a moving conveyor 12 driven around conveyor rollers 14, 16. A stack of pages 20 is supported at an inclined angle on the conveyor 12. At a front side of the stack 20 is arranged a disk separator 24 to be described in detail below.

First stop rollers 26 are arranged on a bottom side of the stack adjacent the conveyor 12. These stop rollers are axially rotatable but fixed in position. Second stop rollers 28 are mounted to a pivotable stop bracket 30 which pivots about an axle 32 of the second stop rollers 28. The bracket 30 provides a rearwardly turned leg 33 which guides a substack of pages toward a driven nip wheel 36 which drives the substack to a guide bracket 38 leading to a nip formed by first and second pull away wheels 44, 46. The pull away wheels press to each other through a recess in the guide bracket 38 and transfer the substack to a further processing station (not shown). wheels 52 is downwardly displaceable to further separate the substack from the stack 20 as described below. FIG. 2 shows the separator disk 24 driven by a drive roller 58 and a belt 59.

Figure 6:
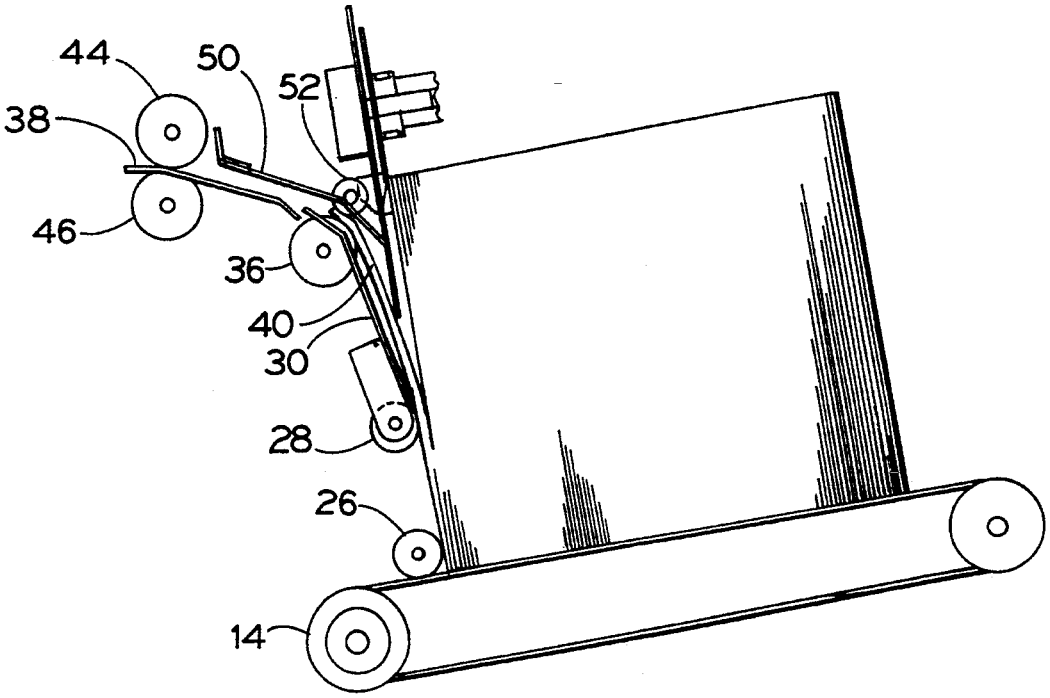
FIG. 6 is an elevational view of the apparatus of FIG. 1 shown in the third orientation.

The operation is generally described by referencing FIG. 1 and FIG. 6. A stack of paper is loaded into the conveyor driven hopper and the sheets are supported in a nearly vertical orientation. The conveyor 12 advances them to the stop rollers 26, 28. In one rotation, the disk lift separator mechanism 24 separates the corner of the substack of sheets from the rest of the stack creating a gap. The wedge 50 is lowered into the gap simultaneously to the rotating stop rotating counterclockwise about the axle 32 according to FIG. 1. The wedge 50 forces the upper half of the substack of sheets to be captured between the continuously rotating driven nip wheels 36 and the idler nip wheels 52. Rotation of these wheels pulls the substack from the stack until the leading edge of the substack reaches the pull away wheels 44, 46. The wedge 50 is then raised to permit the start of the next cycle.

Figure 3A:
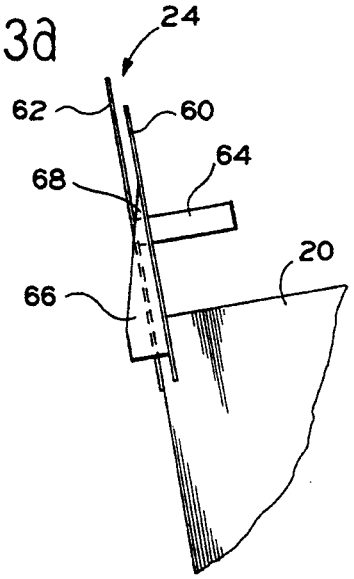
FIGS. 3*a* and 3*b* are partial elevational view and left side view respectively of the apparatus of FIG. 1 in a first orientation.
Figure 3B:
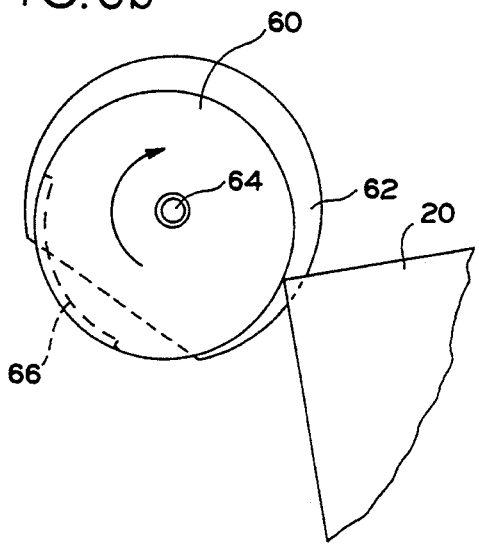

FIGS. 3*a* and 3*b* shows the disk separator 24 at a 90° reference rotation orientation. The stack 20 is supported by a rear disk 62; with further rotation of the separator 24 the substack 40 is defined between the rear disk 62 and a front disk 60. See FIG. 4*a*. A partial perimeter wall or cam 66 proceeds perpendicularly from the front disk 60 toward and past the rear disk 62 having an inclined edge 68. Both the front and rear disks are mounted for rotation about an axle 64.

Figure 4A:
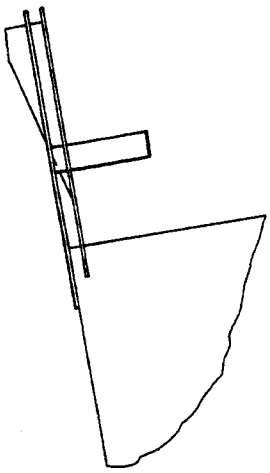
FIGS. 4*a* and 4*b* are partial elevational view and left side view respectively of the apparatus of FIG. 1 in a second orientation.
Figure 4B:
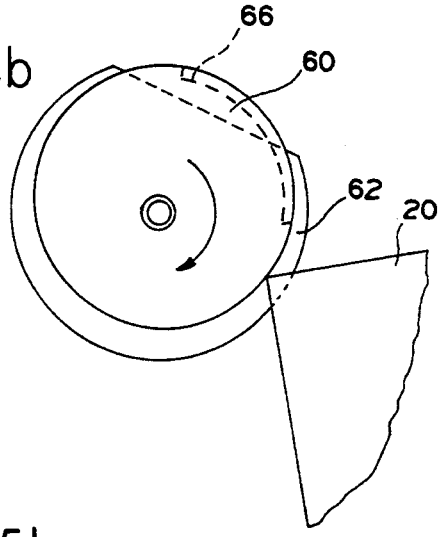

FIGS. 4*a* and 4*b* show the assembly 24 rotated in a further orientation clockwise at a 260° reference rotation. The front disk 60 is just entering the stack to define the substack. The rear disk 62 continues to support the stack until this point. Since the front disk 60 gradually enters the stack at a shallow angle, the paper can part without damage.

Figure 5A:
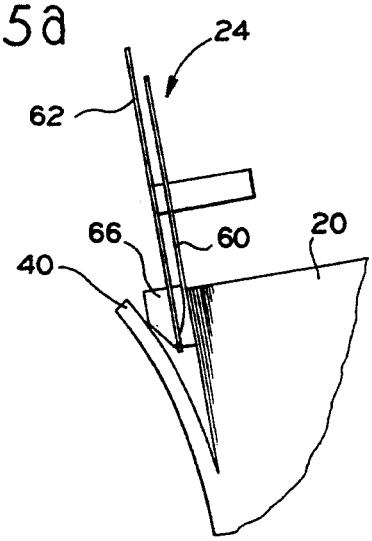
FIGS. 5*a* and 5*b* are a partial elevational view and left side view respectively of the apparatus of FIG. 1 in a third orientation.
Figure 5B:
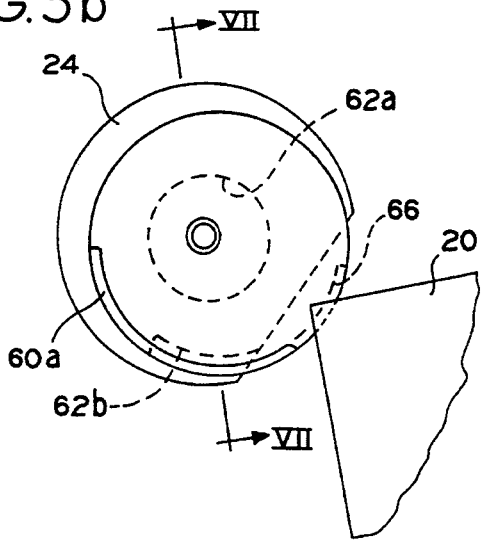

FIGS. 5*a* and 5*b* show the disk assembly 24 at a 0° reference rotation. The substack 40 is bent away from the stack 20 by the wall 66 on the front disk 60.

FIG. 6 shows the wedge 50 in descended position with the idle rollers 52 pressing the substack 40 against the driven nip wheel 36. The substack 40 is driven upward onto the guide bracket 38 and between the nip formed by the pull away wheels 44, 46. The stop bracket 30 has been rotated laterally to guide the substack 40.

Figure 7:
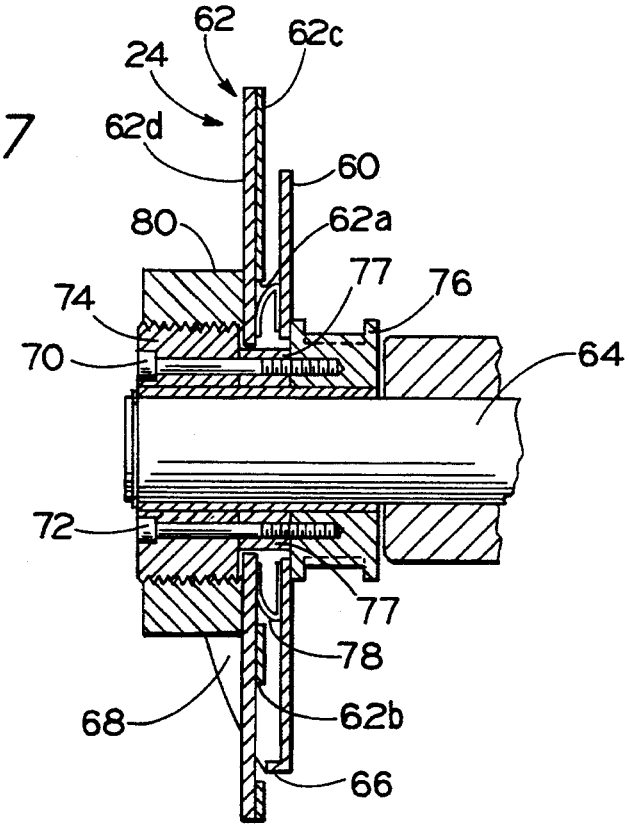
FIG. 7 is an enlarged sectional view taken generally along line VII—VII of FIG. 5*b*.

FIG. 7 shows in more detail the disk assembly 24. Two bolts 70, 72 clamp a threaded sleeve 74 to a timing pulley 76 via spacers 77. The timing pulley is rotated by the belt 59 shown in FIG. 2. A spring 78 located in a central recess 62*a* biases the front disk 60 away from the rear disk 62. An adjusting nut 80 is provided threaded onto the sleeve 74 and by threading inward or outward on the threaded sleeve 74 adjusts the distance between the front and rear disks 60, 62. A peripheral recess 62*b* can be provided on the rear disk 62 for reasons described below. The front disk can have a beveled edge region 60*a* as described below.

The rear disk 62 can be constructed of two plates in sandwich fashion with a front facing plate 62*c* and a rear facing plate 62*d*. The front facing plate 62*c* can have holes and slots therethrough to form the recesses 62*a*, 62*b* respectively.

In particular situations, if the disks lie in a plane of ideally flat sheets of paper in the stack, then paper stock that is curled away from the disk may not be picked consistently, this particularly occurs when the corner of the stack is not resting on the rear disk. A solution to this problem is to tilt the disk toward the curled paper corner so that the paper corner rests on the rear disk.

When the sheets of paper are very thin, a very sharp edge on a beveled edge 60*a* on the front disk 60 can be provided as outlined in FIG. 5*b*. Contrarily, when heavy stock is being run then the sharp beveled edge can split the thicker sheets of paper causing unacceptable damage. A solution to this problem is to radius the beveled edge 60a of the front disk to a radius greater than the paper thickness. This eliminates the damage to the corners of thick sheets, but can require the recess 62*b* in the rear disk as outlined in FIG. 5*b*. The pocket provides more space for the additional sheets that are driven to the space between disks by the radius.

Although the present invention has been described with reference to a specific embodiment, those of skill in the are will recognize that changes may be made thereto without departing from the scope and spirit of the invention as set forth in the appended claims.

I claim as my invention:

1. An apparatus for separating a substack of sheets from a stack of sheets comprising:

a rotatable axle;

a front disk arranged eccentrically on said axis and arranged to penetrate said stack of sheets; and a rear disk arranged on said axle on a back side of said front disk and arranged to support said substack temporarily, said rear disk rotatable with said front disk, a distance between said front disk and said rear disk defining a thickenss of said substack to be removed from said stack of sheets.

2. The apparatus according to claim 1 further comprising an arcuate wall portion extending perpendicularly from said front disk toward said rear disk and having an increasing height from said front disk from a leading end to a trailing end in a direction of rotation.

3. The apparatus according to claim 2, wherein said rear disk comprises a circular shape having a chord segment removed therefrom, and said wall portion extending through said removed portion to pass a corner of said substack through said removed portion upon rotation of said wall portion forming a space between said substack and said stack.

4. The apparatus according to claim 3 further comprising a wedge means vertically positionable down into the space formed between the substack and said stack for further displacing the substack from the stack.

5. The apparatus according to claim 4, wherein said wedge means comprises an idle roller and said apparatus comprises a driven roller facing said idle roller, and upon downward movement of said wedge means into said space, said idle roller presses said substack against said driven roller to transport said substack away from said stack.

6. The apparatus according to claim 5 further comprising two additional driven rollers forming a nip downstream of said driven roller and receiving said substack and transporting said substack away from said stack.

7. The apparatus according to claim 1, comprising means for axially adjusting the distance between said front disk and said rear disk on said axle.

8. The apparatus according to claim 7, wherein said means for axially adjusting comprises a spring between the front and rear disks, and an adjustment nut for moving said rear disk with respect to said front disk against the influence of said spring.

9. The apparatus according to claim 1 further comprising an inclined conveyor holding said stack of sheets in a generally vertically tilted orientation and transporting said stack toward said front disk.

10. A method of removing simultaneously a plurality of sheets forming a substack from a stack of sheets comprising the steps of:

arranging a stack of sheets and progressing the stack toward a separation station;

providing a dual disk rotating separator at the separation station above said stack of sheets and rotating said separator to divide said stack of sheets into successive substacks;

providing a wedge means for separating said substacks from said stack of sheets and moving said wedge means reciprocally to separate said substacks successively; and providing a nip wheel means for removing said substacks as separated from said stack of sheets, and operating said nip wheel means to remove substacks fed thereto.

11. The method according to claim 10, wherein said step of providing said separator comprises providing a front disk having a circumferential wall portion which progressively separates a corner of said successive substacks away from said stack during rotation; and said step of moving said wedge means comprises descending said wedge means into a space left by said separated corner.

12. The method according to claim 11, wherein said step of providing a nip wheel means comprises providing an idle roller reciprocally movable with said wedge means and a driven roller, said idle roller presses said substack against said driven roller for removing said substack from said stack.

13. The method according to claim 10, wherein said step of progressing the stack of sheets comprises arranging the stack on a moving conveyor, moving toward said separator.

* * * * *